US011110702B2

(12) United States Patent
Martin et al.

(10) Patent No.: US 11,110,702 B2
(45) Date of Patent: Sep. 7, 2021

(54) CONTROLLING RECIRCULATING OF NOZZLES

(71) Applicant: Hewlett-Packard Development Company, L.P., Spring, TX (US)

(72) Inventors: Eric Martin, Corvallis, OR (US); Vincent C Korthuis, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/857,403

(22) Filed: Apr. 24, 2020

(65) Prior Publication Data

US 2020/0247116 A1 Aug. 6, 2020

Related U.S. Application Data

(63) Continuation of application No. 16/306,611, filed as application No. PCT/US2016/055133 on Oct. 3, 2016, now Pat. No. 10,668,720.

(51) Int. Cl.
*B41J 2/045* (2006.01)
*B41J 2/18* (2006.01)

(52) U.S. Cl.
CPC ..... *B41J 2/04541* (2013.01); *B41J 2/0458* (2013.01); *B41J 2/04586* (2013.01); *B41J 2/18* (2013.01); *B41J 2202/12* (2013.01)

(58) Field of Classification Search
CPC .. B41J 2/04541; B41J 2/0458; B41J 2/04586; B41J 2/18; B41J 2202/12
See application file for complete search history.

(56) References Cited

U.S. PATENT DOCUMENTS

| | | | |
|---|---|---|---|
| 6,244,694 | B1 | 6/2001 | Weber |
| 7,029,084 | B2 | 4/2006 | Schloeman |
| 7,407,258 | B2 | 8/2008 | Nakahara |
| 2005/0230493 | A1 | 10/2005 | Benjamin |
| 2005/0231546 | A1 | 10/2005 | Tobita |
| 2006/0214961 | A1 | 9/2006 | Nakahara |
| 2008/0186344 | A1 | 8/2008 | Hara |

(Continued)

FOREIGN PATENT DOCUMENTS

| | | |
|---|---|---|
| CN | 1647930 | 8/2005 |
| CN | 1672928 | 9/2005 |

(Continued)

OTHER PUBLICATIONS

Printheads Used in Wide Format, Mar. 2016, <http://www.digitaloutput.net/integral-parts/>.

*Primary Examiner* — Bradley W Thies
(74) *Attorney, Agent, or Firm* — HP Inc. Patent Department

(57) ABSTRACT

In some examples, a fluid ejection device includes a nozzle to dispense fluid, and a recirculation controller to control recirculating of the nozzle. The recirculation controller is to receive, from a fluid ejection controller, an indication corresponding to a start of a sampling time interval, determine, during the sampling time interval, whether a firing event corresponding to firing of the nozzle has occurred, and in response to determining that the firing event has not occurred, cause activation of a recirculation pump to recirculate fluid through a chamber of the nozzle.

18 Claims, 6 Drawing Sheets

(56) References Cited

U.S. PATENT DOCUMENTS

| | | | | |
|---|---|---|---|---|
| 2011/0279558 | A1 | 11/2011 | Hibbard | |
| 2017/0096016 | A1* | 4/2017 | Govyadinov | B41J 2/14032 |

FOREIGN PATENT DOCUMENTS

| | | | |
|---|---|---|---|
| CN | 1972804 | | 5/2007 |
| CN | 101234556 | | 8/2008 |
| CN | 101970241 | | 2/2011 |
| CN | 102985261 | | 3/2013 |
| CN | 103153627 | | 6/2013 |
| EP | 2918417 | A1 | 9/2015 |
| JP | 2013544678 | | 12/2013 |
| JP | 2017537000 | | 12/2017 |
| WO | WO-2016068987 | | 5/2016 |
| WO | WO-2016068988 | | 5/2016 |
| WO | WO-2016068989 | | 5/2016 |

* cited by examiner

CONTROLLING RECIRCULATING OF NOZZLES

RELATED APPLICATIONS

The present application claims priority to U.S. patent application Ser. No. 16/306,611, entitled "CONTROLLING RECIRCULATING OF NOZZLES," filed in the U.S. on Dec. 3, 2018, and which is a U.S. National stage case of PCT PCT/US2016/055133, filed in the U.S. Receiving Office on Oct. 3, 2016, and which are hereby incorporated herein by reference.

BACKGROUND

A printing system can include a printhead that has nozzles to dispense printing fluid to a target. In a two-dimensional (2D) printing system, the target is a print medium, such as a paper or another type of substrate onto which print images can be formed. Examples of 2D printing systems include inkjet printing systems that are able to dispense droplets of inks. In a three-dimensional (3D) printing system, the target can be a layer or multiple layers of build material deposited to form a 3D object.

BRIEF DESCRIPTION OF THE DRAWINGS

Some implementations of the present disclosure are described with respect to the following figures.

DETAILED DESCRIPTION

Figure 1:
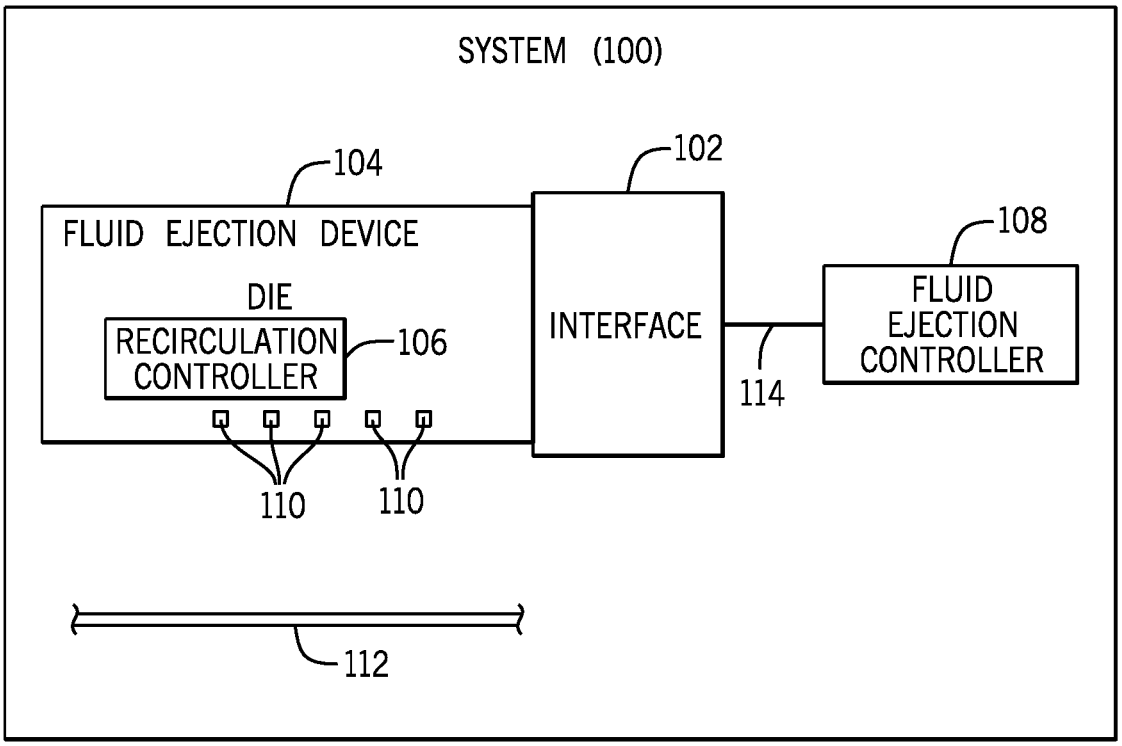
FIG. 1 is a block diagram of an example system capable of receiving a fluid ejection device that includes a local recirculation controller, according to some implementations.

In the present disclosure, the article "a," "an", or "the" can be used to refer to a singular element, or alternatively to multiple elements unless the context clearly indicates otherwise. Also, the term "includes," "including," "comprises," "comprising," "have," or "having" is open ended and specifies the presence of the stated element(s), but does not preclude the presence or addition of other elements.

A printhead for use in a printing system can include nozzles that are activated to cause printing fluid droplets to be ejected from respective nozzles. Each nozzle includes a heating element that when activated generates heat to vaporize a printing fluid in a firing chamber of the nozzle, which causes expulsion of a droplet of the printing fluid from the nozzle. A printing system can be a two-dimensional (2D) or three-dimensional (3D) printing system. A 2D printing system dispenses printing fluid, such as ink, to form images on print media, such as paper media or other types of print media. A 3D printing system forms a 3D object by depositing successive layers of build material. Printing fluids dispensed by the 3D printing system can include ink, as well as fluids used to fuse powders of a layer of build material, detail a layer of build material (such as by defining edges or shapes of the layer of build material), and so forth.

In the ensuing discussion, the term "printhead" can refer generally to a printhead die or an overall assembly that includes multiple printhead dies mounted on a support structure. Although reference is made to a printhead for use in a printing system in some examples, it is noted that techniques or mechanisms of the present disclosure are applicable to other types of fluid ejection devices used in non-printing applications that are able to dispense fluids through nozzles. Examples of such other types of fluid ejection devices include those used in fluid sensing systems, medical systems, vehicles, fluid flow control systems, and so forth.

Evaporation of water or another solvent from a fluid exposed to an ambient environment can cause the fluid to dry out at nozzles of a fluid ejection device. In some examples, the drying of a fluid of a fluid ejection device can alter trajectories of fluid droplets, velocities of ejected fluid droplets, and/or shapes and colors of fluid droplets. For a 2D printing system, the foregoing effects can lead to reduced image quality in an image printed onto a print medium. For a 3D printing system, the foregoing effects can reduce effectiveness of dispensed printing fluids as part of the process of forming a 3D object. For a non-printing system, the foregoing effects can cause a dispensed fluid from the fluid ejection device to not perform in a target manner or not to be able to achieve a target result.

In printing systems, a decap time is specified for a printhead, where the decap time can refer to an amount of idle time that the nozzles of the printhead can be left uncapped (i.e., not covered with a cap) and still be able produce a high quality image (based on a specified criterion) or otherwise achieve a target result when the nozzles are fired to dispense fluid droplets. An idle time of a nozzle can refer to the time when the nozzle is not fired.

To address the issue of drying of ink or other fluid at nozzles of a printhead, recirculation of the ink or other fluid can be performed at the nozzles. The recirculation can include circulating fresh fluid through a firing chamber of a nozzle; the recirculation does not cause the fluid to be ejected from the nozzle (i.e., the nozzle is not fired). Recirculation of fluid in a nozzle can be referred to as micro-recirculation where the fluid is circulated through micro-fluidic channels, which are channels having fluid flow areas in the micrometer range (less than 1,000 micrometers, for example).

In some cases, a printer controller of a printing system can pre-process image data (that is to be printed by the printing system) to determine a length of time each nozzle of a printhead has been left idle. Based on the pre-processing, the printer controller can determine if any nozzle has been left idle for longer than a decap time, and if so, recirculation commands can be inserted into the image data to cause recirculation at each nozzle that has been left idle for longer than the decap time. However, the pre-processing performed by the print controller to keep track of how long each nozzle has been left idle and to insert recirculation commands is computationally intensive, and can reduce processing bandwidth of the printer controller. Moreover, the recirculation commands that are sent by the printer controller to the printhead include information (e.g., address data) of individual nozzles that are to be recirculated. As a result, sending such recirculation commands can consume the communications bandwidth of a communications link between the printer controller and the printhead.

The concept of "decap time" can also apply to other types of fluids dispensed by other types of fluid ejection devices. More generally, a decap time is specified for a fluid ejection device, where the decap time can refer to an amount of idle time that the nozzles of the fluid ejection device can be left idle and still be able achieve a target goal (based on a specified criterion) when the nozzles are fired to dispense fluid droplets.

In accordance with some implementations of the present disclosure, a decision of whether or not to perform recirculation of each nozzle of a printhead can be performed by a local controller of the printhead, rather than by the printer controller that is implemented separately from the printhead. In some implementations, a printhead can be a printhead die or can include multiple printhead dies. A printhead die can refer to a chip or other integrated circuit device that includes a substrate in which is provided nozzles and control circuitry to control ejection of a printing fluid by the nozzles. The control circuitry on the substrate can include a firing controller that controls firing of nozzles in response to print packets, as well as the local controller (referred to in the ensuing discussion as a "recirculation controller") that is able to make a local determination of whether or not recirculation is to performed for each individual nozzle of the printhead.

By using the recirculation controller that is locally provided in the printhead, the printer controller would not have to make a determination of which nozzles are to be recirculated, and would not have to individually address each nozzle of the printhead to perform recirculation at the nozzle. The recirculation controller of the printhead can locally determine whether recirculation of nozzles is to be performed, without having to receive a recirculation command from the printer controller, where the recirculation command individually addresses a nozzle (or a group of nozzles) for recirculation. As a result, the processing burden on the printer controller is reduced, and there is less consumption of the communications bandwidth between the printer controller and the printhead.

In some implementations, the printer controller can send a first indication that corresponds to a start of a sampling time interval during which the recirculation controller can decide whether or not a nozzle is to be recirculated, and a second indication (a recirculation enable indication) that indicates a recirculation enable time during which recirculation of the nozzles is allowed. Neither the first indication nor the second indication includes information (e.g., address data) used to individually select nozzles. Although reference is made to first and second indications, it is noted that in further examples, just one indication (such as the first indication) can be provided by the printer controller to the recirculation controller, or alternatively, more than two indications can be provided from the printer controller to the recirculation controller.

The first and second indications can be in the form of messages, information elements within messages, or signals. A message can be sent by the printer controller over a communications link. An information element within a message can include an information element within a header or a payload of the message. For example, the message can include a print packet that is sent by the printer controller to the printhead to control firing of selected nozzles of the printhead. The print packet can include, among other information, address data corresponding to an address of a nozzle (or a group of nozzles) that is to be selected for firing. More generally, the print packet includes information that can be used to identify a nozzle (or a group of nozzles) that is to be selected for firing. Firing a nozzle refers to activating a nozzle to eject a printing fluid. For example, the nozzle can have a firing resistor or other heating element that is activated to cause rapid vaporization of a printing fluid in a firing chamber, which causes a droplet of ink to be propelled through an opening of the nozzle toward a print medium.

The information element within the print packet can include a bit (or multiple bits) that can be set to respective bit values. The bit(s) if included in the header of the print packet allows a print packet carrying information that causes firing of nozzles to also carry the first and second indications without having to use separate packets. In some examples, setting a first bit in the header of the print packet to a first value provides the first indication, while setting a second bit in the header of a print packet to a specified value provides the second indication.

Although reference is made to local control of fluid recirculation at nozzles of a printhead, it is noted that in other examples, local control of fluid recirculation using techniques or mechanisms according to some implementations of the present disclosure can be applied to nozzles of other types of fluid ejection devices.

FIG. 1 is a block diagram of an example system 100, such as a 2D printing system, a 3D printing system, or a non-printing system. The system 100 includes an interface 102 to receive a fluid ejection device 104 (e.g., a printhead or other type of fluid ejection device). The interface 102 can include an electrical interface to allow an electronic component in the system 100 to communicate with the fluid ejection device 104. Moreover, in some examples, the interface 102 can include a mechanical mounting structure to mechanically mount the fluid ejection device 104 in the system 100.

In some examples, the fluid ejection device 104 can be implemented as an integrated circuit (IC) die that includes a substrate on which is provided nozzles and control circuitry to control ejection of a fluid by the nozzles. In other examples, the fluid ejection device 104 can include a structure (such as an ink cartridge) that has a fluid reservoir containing a fluid, fluid channels connected to the fluid reservoir, and a die or multiple dies including nozzles and control circuitry to control ejection of a fluid by the nozzles.

In some examples, the fluid ejection device 104 can be fixedly mounted in the system 100, such as on a carriage of the system 100, where the carriage is moveable with respect to a target 112 onto which fluid is to be dispensed from the fluid ejection device 104. In other examples, the fluid ejection device 104 can be removably connected to the interface 102. For printing systems where the fluid ejection device 104 is a printhead, an example configuration where a printhead can be removably mounted in a printing system is in the context of an integrated printhead that is part a printing fluid cartridge (e.g., an ink cartridge). With an integrated printhead, a printhead die is attached to the printing fluid cartridge. The printing fluid cartridge is removably mounted in the printing system; for example, the printing fluid cartridge can be removed from the printing system and replaced with a new printing fluid cartridge.

In yet further examples, a printing system can be a page-wide printing system, where a row of printheads can be arranged along the width of a target so that printing fluid can be dispensed simultaneously from the printheads. More generally, a system can include multiple fluid ejection devices arranged along a line or in an array or any other pattern to dispense fluid to a target.

In examples according to FIG. 1, the fluid ejection device 104 includes a local recirculation controller 106 that is locally provided in the fluid ejection device 104. The local recirculation controller 106 is separate from a fluid ejection controller 108 of the system 100. In a printing system, the fluid ejection controller 108 is a printer controller that controls printing operations.

As used here, a "controller" can refer to a hardware processing circuit, which can include any or some combination of the following: a microprocessor, a core of a multi-core microprocessor, a microcontroller, a programmable gate array, a programmable integrated circuit device, or another hardware processing circuit. Alternatively, a "controller" can refer to a combination of a hardware processing circuit and machine-readable instructions executable on the hardware processing circuit.

The fluid ejection device 104 also includes nozzles 110 through which fluid can be ejected onto the target 112. In further examples, the system 100 can include multiple fluid ejection devices 104 each including a respective recirculation controller 106 and nozzles 110.

The fluid ejection controller 108 is able to communicate with the fluid ejection device 104, and more specifically with the recirculation controller 106, over a communications link 114. The fluid ejection controller 108 can send respective first and second indications to the fluid ejection device 104 over the communications link 114. The first indication starts a sampling time interval, and the first indication is to trigger the recirculation controller 106 to control recirculating of a given nozzle 110 based on a determination, during the sampling time interval, by the recirculation controller 106 of whether a firing event corresponding to firing of the given nozzle has occurred. As explained further below, the sampling time interval is a fraction of a decap time associated with a fluid to be ejected by the fluid ejection device 104. The decap time can be set by the fluid ejection controller 108, such as by firmware or other machine-readable executable instructions that can be executed by the fluid ejection controller 108.

The recirculation controller 106 and the fluid ejection controller 108 are separate from one another. For example, the fluid ejection controller 108 can be provided on a main circuit board in the printing system 100, whereas the recirculation controller 106 is locally provided in the fluid ejection device 104 (e.g., on a die of the fluid ejection device 104).

Figure 2:
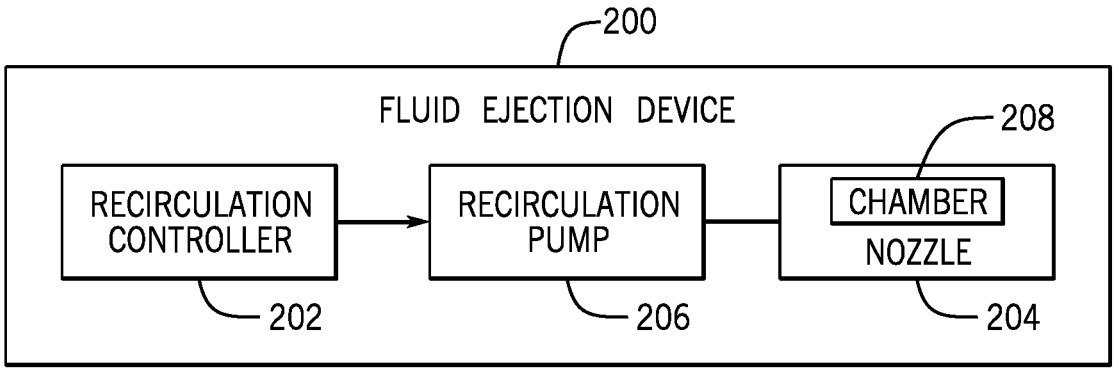
FIG. 2 is a block diagram of a fluid ejection device according to some examples.

FIG. 2 is a block diagram of an example fluid ejection device 200, which can be a die or an assembly that includes one or multiple dies along with other associated components. The fluid ejection device 200 includes a recirculation controller 202, which can be the recirculation controller 106 shown in FIG. 1. The fluid ejection device 200 also includes a nozzle 204 and a recirculation pump 206 associated with the nozzle 204. The recirculation pump 206 in some examples can be in the form of a pump resistor that when activated causes a fluid to flow through a fluid recirculation channel within the fluid ejection device 200 to refresh the fluid that is present in a firing chamber 206 of the nozzle 204. In other examples, the recirculation pump 206 can be implemented as a piezoelectric actuator or any other component that when activated can cause a fluid to move.

In some examples, the recirculation controller 202 controls recirculating of the nozzle 204. The recirculation controller 202 receives, from a fluid ejection controller (e.g., the fluid ejection controller 108 of FIG. 1), a first indication corresponding to a start of a sampling time interval. The recirculation controller 202 further determines, during the sampling time interval, whether a firing event corresponding to firing of the nozzle 204 has occurred. A firing event can be indicated by a firing command included in a print packet received from the fluid ejection controller 108 for firing the nozzle 204. In response to determining that the firing event has not occurred within a specified range of time, the recirculation controller 202 can cause activation of the recirculation pump 206 to recirculate printing fluid through the firing chamber 206 of the nozzle 204.

In some examples, the specified range of time is a function of the decap time for a fluid to be dispensed by the nozzle 204. The decap time can be determined as a function of properties of the fluid. Different fluids can be associated with different decap times.

Figure 3:
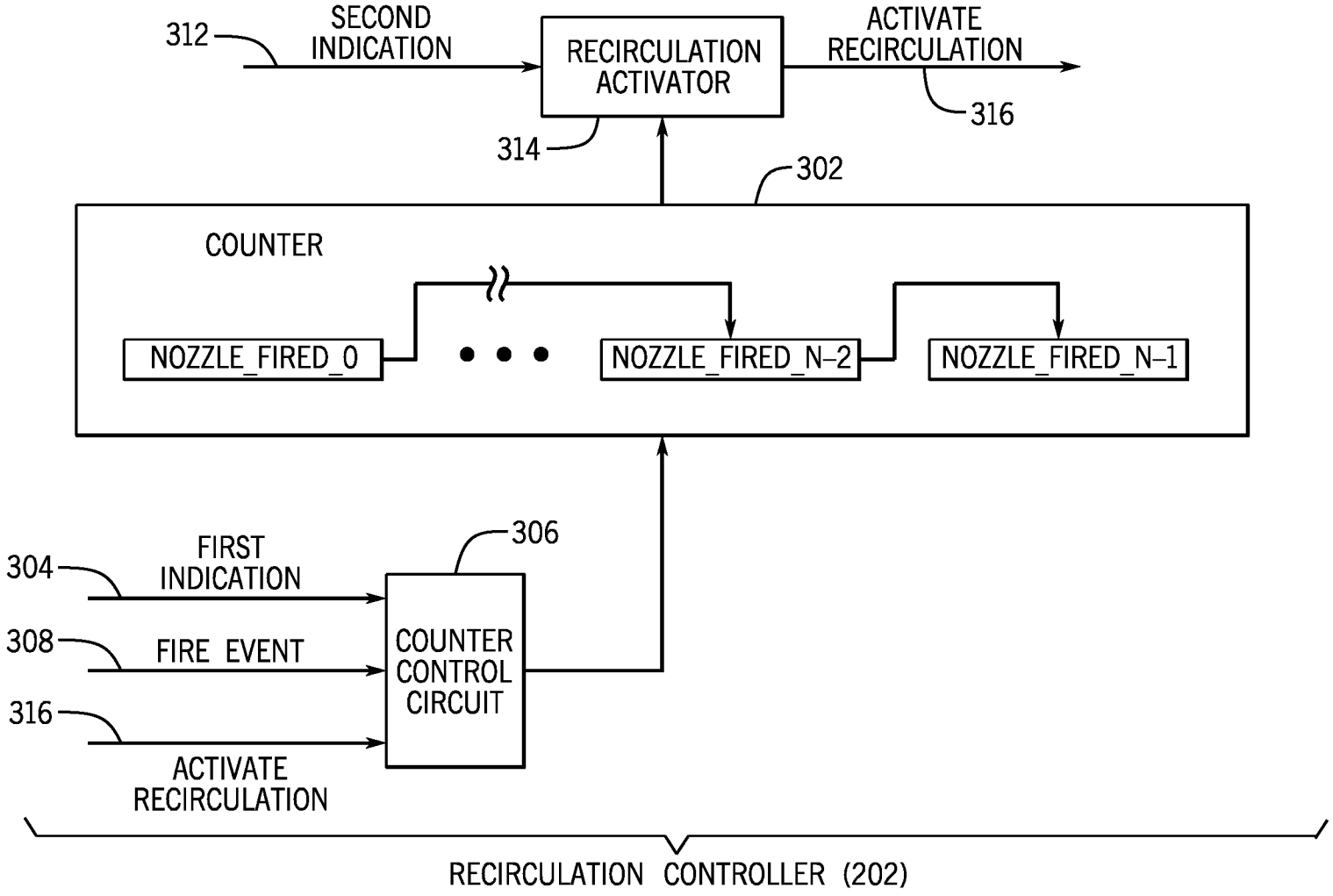
FIG. 3 is a block diagram of a recirculation controller according to some examples.

FIG. 3 is a block diagram of an example arrangement of the recirculation controller 202, which includes a counter 302, a counter control circuit 306, and a recirculation activator 314. Each of the counter 302, the counter control circuit 306, and the recirculation activator 314 can be implemented as a hardware processing circuit, or as a combination of machine-readable instructions executable on the hardware processing circuit.

The counter 302 includes multiple memory elements, referred to as NOZZLE_FIRED_0, . . . NOZZLE_FIRED_N−2, and NOZZLE_FIRED_N−1 in FIG. 3. In examples according to FIG. 3, the counter 302 includes N memory elements, where N≥1. There is one counter per nozzle or group of nozzles of a fluid ejection device. The recirculation controller 202 can include multiple counters 302 for respective nozzles or groups of nozzles.

The memory elements can include elements of a register or another type of storage device. In the following example, it is assumed that N is greater than 1 to illustrate an example where there are multiple memory elements in the counter 302. The multiple memory elements are arranged in a series where the output of one memory element can be connected to the input of another memory element. In other examples, there can just be one memory element in the counter 302.

Generally, the counter 302 is used to track an elapsed time since a respective nozzle has been fired. As long as the nozzle has not fired, the counter 302 continues to update its value. In some examples, the updating of the value involves shifting a state of a predecessor memory element into a successor memory element of the counter 302. For example, if a firing event has not occurred during a sampling time interval (started by a first indication 304 shown in FIG. 3), the state of NOZZLE_FIRED_N−1 is loaded with the state of a previous memory element NOZZLE_FIRED_N−2 in the series of memory elements. More generally, the state of NOZZLE_FIRED_i (i=1 to N−1) is set to the state of NOZZLE_FIRED_i−1 in response to the nozzle not having been fired during a sampling time interval. In this example, NOZZLE_FIRED_i−1 is the predecessor memory element, and NOZZLE_FIRED_i is the successor memory element. A successor memory element refers to a memory element in a series whose input is connected to the output of another memory element, which is the predecessor memory element to the successor memory element.

Although a specific implementation of the counter 302 is shown in FIG. 3, it is noted that in further examples, the counter 302 can be implemented in other ways.

Additionally, the counter control circuit 306 is used to control the counter 302, such as by causing the counter 302 to be updated or reset in response to certain events. In some examples, the following events can occur: (1) the end of a sampling time interval, (2) a fire event, and (3) a recirculation event.

Recirculation of a nozzle is triggered if the counter 302 has reached a specified value. If a fire event or a recirculation event has not occurred, then the counter 302 continues to be updated in successive sampling time intervals, until the counter 302 reaches the specified value that triggers performance of the recirculation of the nozzle. However, if a fire event occurs or a recirculation event occurs, then the counter 302 is reset to a value that is different from the specified value.

The following provides further details of an example implementation of the recirculation controller 202. It is noted that in other examples, a different arrangement of the recirculation controller 202 can be employed.

A first indication 304 when received by the recirculation controller 202 indicates a start of a sampling time interval during which the recirculation controller 202 can decide whether or not a nozzle is to be recirculated. The sampling time interval has a length that depends on the number of memory elements used in the counter 302. An increased number (N) of memory elements used in the counter 302 corresponds to a smaller length of the sampling time interval. More specifically, the length of the sampling time interval is set equal to DECAP_TIME/(N+1), where DECAP_TIME represents the decap time of the fluid to be dispensed by a nozzle. Thus, the sampling time interval is determined as a fraction of the decap time, based on the number of memory elements included in the counter 302. For example, if there is just one memory element in the counter 302, then the sampling time interval has a length that is half the decap time. On the other hand, if there are two memory elements in the counter 302, then the sampling time interval is one third of the decap time.

The counter control circuit 306 is able to determine the end of the sampling time interval from receipt of the first indication 304. At the end of the sampling time interval, if recirculation has not occurred in the sampling time interval, the counter control circuit 306 causes the counter 302 to be updated in value, such as by resetting NOZZLE_FIRED_0 to '0', and for i=1 to N−1, setting each of NOZZLE_FIRED_i to NOZZLE_FIRED_i−1.

At the end of the sampling time interval, if recirculation has occurred (i.e., a recirculation event has occurred), the counter control circuit 306 performs a recirculation reset of the counter 302 as follows: set NOZZLE_FIRED_0 to '0', and set the remaining memory elements NOZZLE_FIRED_1 to NOZZLE_FIRED_N−1 to '1'. The recirculation event is indicated if an ACTIVATE RECIRCULATION signal 316 is asserted to an active state.

In response to receipt of a Fire Event 308 (e.g., as indicated by a print packet containing a command to activate a nozzle), the counter control circuit 306 performs a fire reset of the counter 302 as follows: reset all memory bits NOZZLE_FIRED_0 to NOZZLE_FIRED_N−1 of the counter 302 to '1'.

Although the present disclosure refers to specific examples where memory elements of the counter 302 are set or reset to specific values in response to corresponding events, in other examples, the counter 302 can be updated or reset in different ways.

Each sampling time interval has a sub-portion that is referred to as a recirculation enable time interval. The recirculation enable time interval of a sampling time interval is the time interval during which recirculation of a nozzle can be activated in response to the counter 302 having a specified value (e.g., all memory elements of the counter 302 are set to '0'). In other examples, the specified value for triggering recirculation of a nozzle can be a different value.

The recirculation enable time interval is started in response to receiving a second indication 312, which is provided to the input of the recirculation activator 314. In some examples, the recirculation enable time interval makes up the end portion of the sampling time interval (e.g., the last few milliseconds of the sampling time interval). The length of the recirculation enable time indicated by the second indication 312 is generally much less than the length of the sampling time interval. For example, the decap time may be 800 milliseconds in some examples, while the recirculation enable time interval can be 16 milliseconds. Although specific lengths of the decap time and recirculation enable time interval are provided, it noted that in other examples, the decap time and recirculation enable time interval can have other lengths.

In response to receiving the second indication 312, the recirculation activator 314 checks, during the recirculation enable time interval, the counter 302 to determine whether the counter 302 (or more specifically, memory elements NOZZLE_FIRED_0 to NOZZLE_FIRED_N−1) has the specified value. If the counter 302 does not have the specified value, the recirculation activator 314 de-asserts the ACTIVATE RECIRCULATION signal 316 to an inactive state. In response to determining that the counter 302 has the specified value (e.g., all of the memory elements are set to 0), the recirculation activator 314 asserts the ACTIVATE RECIRCULATION signal 316 to an active state. The ACTIVATE RECIRCULATION signal 316 is provided to the recirculation pump 206 (FIG. 2). Assertion of the ACTIVATE RECIRCULATION 316 causes the recirculation pump 206 to recirculate the respective nozzle 204.

Generally, occurrence of a fire event or a recirculation event would reset the counter 302 such that the recirculation controller 202 would wait until the counter 302 reaches the specified value again in a later sampling time interval before recirculation is activated.

Assuming that the length of a sampling time interval is represented by SAMPLING_LENGTH, and the decap time is represented by DECAP_TIME, for the counter 302 having N memory elements, the recirculation controller 202 activates recirculation of a nozzle in response to determining that the nozzle has not been fired by an amount of time that falls in the time range from N* (SAMPLING_LENGTH) to DECAP_TIME. This time range can also be expressed as N*(DECAP_TIME/(N+1)) to DECAP_TIME, since SAMPLING_LENGTH=DECAP_TIME/(N+1).

The recirculation controller 202 can cause triggering of the recirculation of a given nozzle as early as N*(DECAP_TIME/(N+1)) from the latest firing event of the given nozzle, or at the latest at DECAP_TIME from the latest firing event for the given nozzle.

Figure 4A:
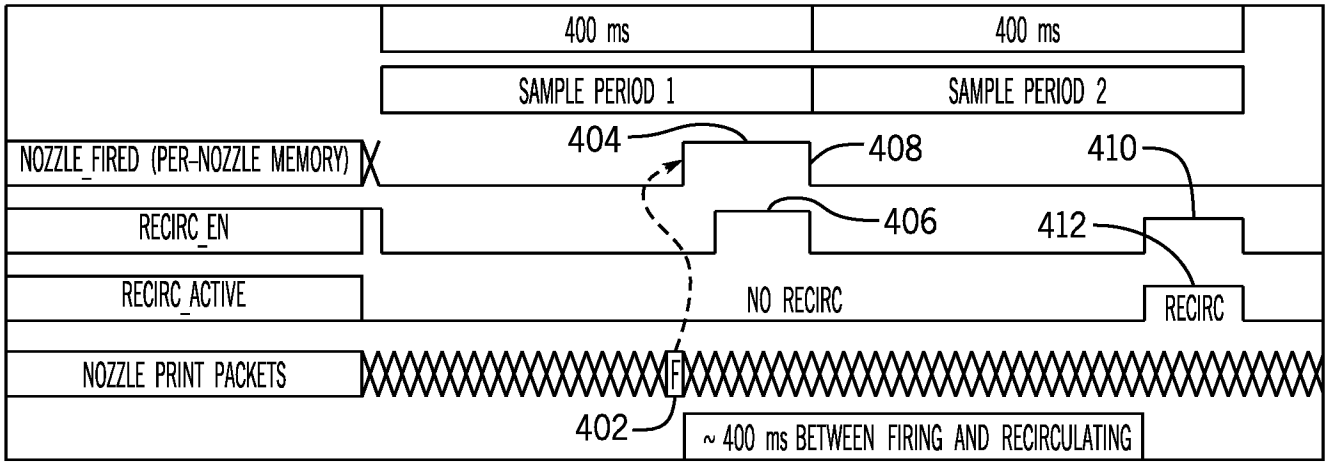
FIGS. 4A-4C and 5A-5B are timing diagrams of operation of a recirculation controller according to some examples.
Figure 4B:
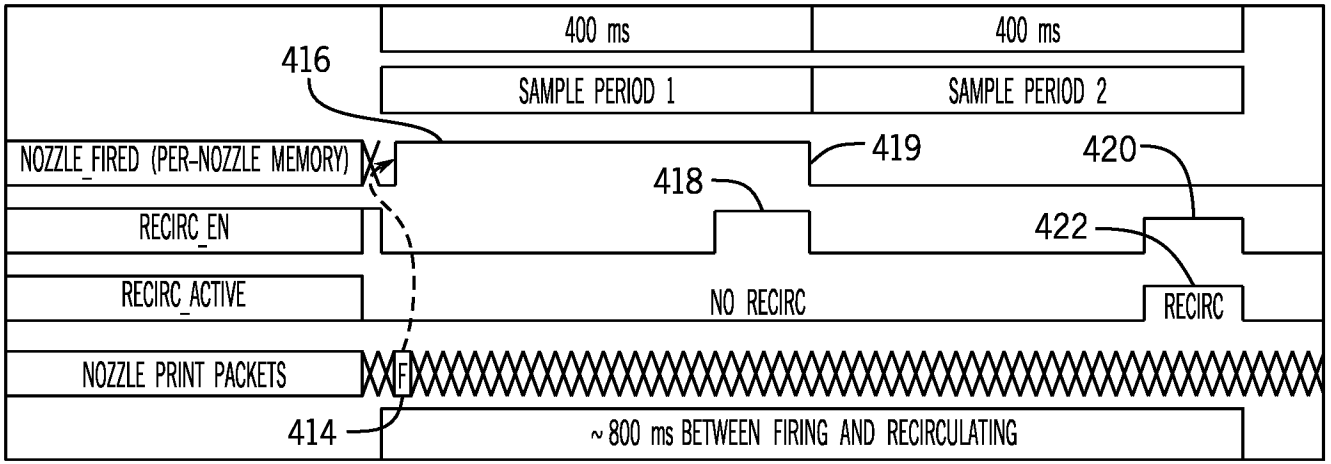
Figure 4C:
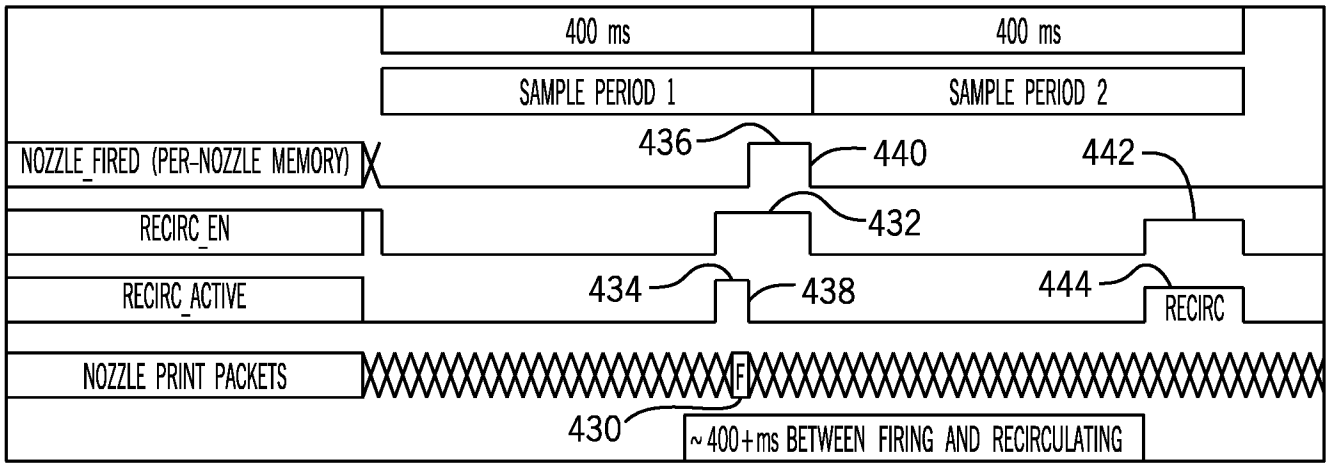

FIGS. 4A-4C are timing diagrams that illustrate examples in which just one memory element is included in the counter 302 (i.e., N=1). In the example of FIGS. 4A-4C, the decap time is assumed to be 800 milliseconds (ms), and each sampling time interval (sample period 1 and sample period 2) is thus 400 ms in length.

The one memory element of the counter 302 is represented as NOZZLE_FIRED in FIGS. 4A-4C. Also, in FIGS. 4A-4C, RECIRC_EN when asserted to a '1' specifies that recirculation is enabled (as triggered by the receipt of the second indication 312 in FIG. 3). RECIRC_ACTIVE when asserted to a '1' indicates whether or not recirculation is being performed at a nozzle. Nozzle print packets are represented by a sequence of X's. An F indication in a nozzle print packet indicates that a firing command for the nozzle is included in the nozzle print packet. Thus, the F indication corresponds to a fire event.

In FIG. 4A, the F indication is included in a nozzle print packet 402, which causes NOZZLE_FIRED of the counter 302 to be reset to 1 (404). During the recirculation enable time interval 406 at the end of sample period 1, the recirculation controller 202 determines that NOZZLE_FIRED is at value 1, and thus no recirculating is triggered during the recirculation enable time interval 406 in sample period 1.

At the end of sample period 1, NOZZLE_FIRED is reset to '0' (408).

In FIG. 4A, in sample period 2, a fire event is not received for the nozzle, and as a result, NOZZLE_FIRED of the counter 302 remains at '0'. In the recirculation enable time interval 410 in sample period 2, the recirculation controller 202 detects that NOZZLE_FIRED is at 0, and thus asserts the ACTIVATE RECIRCULATION signal 316 to trigger performance of a recirculation of the nozzle (412). Note that the recirculation (412) of the nozzle can include multiple pumps of the nozzle, where each pump corresponds to a respective activation of the recirculation pump 206 (FIG. 2). For example, over the duration of the recirculation enable time interval represented by 412, one thousand (or some other number of) pumps can be performed.

In FIG. 4A, the fire event (402) occurs closer to the end of the sample period 1. FIG. 4B shows an example where a fire event (414) occurs near the beginning of sample period 1. In response to the fire event, NOZZLE_FIRED of the counter 302 is reset to '1' (416). As a result, during the recirculation enable time interval 418 in sample period 1, the recirculation controller 202 determines that NOZZLE_FIRED has the value '1' and thus no recirculation of the nozzle is triggered during the recirculation enable time interval 418.

At the end of sample period 1, NOZZLE_FIRED is reset to '0' (419).

In FIG. 4B, in sample period 2, no fire event is received for the nozzle, and as a result, during the recirculation enable time interval 420 of sample period 2, the recirculation controller 202 detects that NOZZLE_FIRED of the counter 302 has the 0 value, and in response, recirculation of the nozzle is triggered (422).

In FIG. 4B, a longer time period transpires between the fire event 414 and the recirculation (422) than a time period between the fire event 402 and the recirculation (412) of FIG. 4A.

FIG. 4C shows an example where a fire event 430 occurs during the recirculation enable time interval 432 in sample period 1. At the start of the recirculation enable time interval 432, NOZZLE_FIRED of the counter 302 is at '0'. As a result, the recirculation controller 202 activates recirculation (434) at the beginning of the recirculation enable time interval 432. As a result of the firing event 430, NOZZLE_FIRED is reset to '1' (436), and in response, the recirculation controller 202 deactivates the recirculation (438), by de-asserting the ACTIVATE RECIRCULATION signal 316.

At the end of sample period 1, NOZZLE_FIRED of the counter 302 is reset to '0' (440). In sample period 2, during the recirculation enable time interval 442, recirculation (444) is triggered in response to NOZZLE_FIRED of the counter 302 having the value '0'.

Figure 5A:
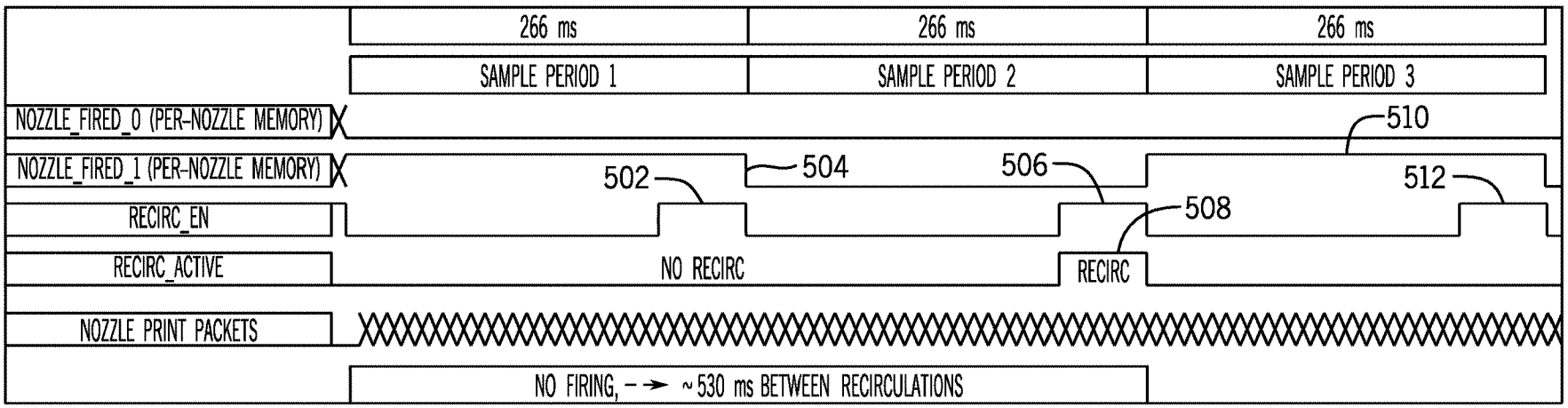
Figure 5B:
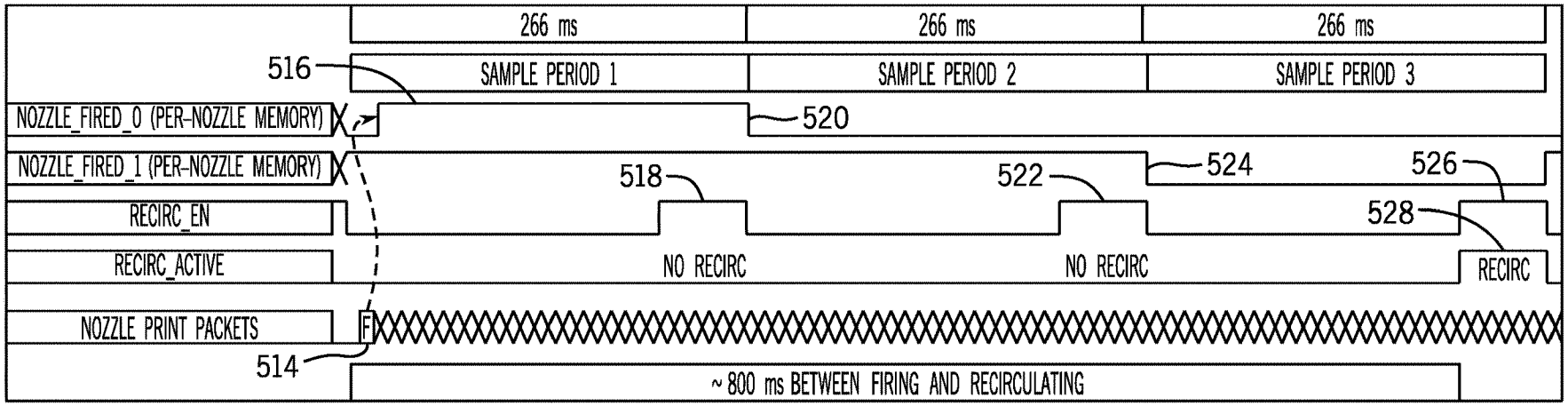

FIGS. 5A and 5B are timing diagrams for examples where two memory elements are used in the counter 302 (i.e., N=2). Assuming that the decap time is 800 ms, then with two memory elements, the length of each sampling time interval is approximately 266 ms. FIGS. 5A and 5B include sample period 1, sample period 2, and sample period 3 (three sampling time intervals). The two memory elements of the counter 302 are represented as NOZZLE_FIRED_0 and NOZZLE_FIRED_1.

In FIG. 5A, no firing event is received in any of sample periods 1, 2, and 3. It is assumed that NOZZLE_FIRED_0 is at value '0' and NOZZLE_FIRED_1 is at value '1' at the beginning of sample period 1. In the recirculation enable time interval 502 in sample period 1, since NOZZLE_FIRED_1 is at '1', the recirculation controller 202 does not activate recirculation of the nozzle. At the end of sample period 1, NOZZLE_FIRED_1 is set equal to the value of the NOZZLE_FIRED_0 (504) (in this case '0', and NOZZLE_FIRED_0 is reset to '0'.

In the recirculation enable time interval 506 in sample period 2, the recirculation controller 202 detects that both NOZZLE_FIRED_0 and NOZZLE_FIRED_1 are at '0', and as a result, the recirculation controller 202 triggers recirculation (508). As a result of activating recirculation of the nozzle, NOZZLE_FIRED_0 is reset to '0' and NOZZLE_FIRED_1 is reset to '1' (510) at the end of sample period 2. Since NOZZLE_FIRED_1 has been reset to '1' as a result of the recirculation (508) performed in sample period 2, recirculation is not triggered during recirculation enable time interval 512 in sample period 3.

FIG. 5B shows an example where a fire event 514 occurs near the beginning of sample period 1. The fire event 514 causes resetting of NOZZLE_FIRE_0 to '1' (516). As a result of both NOZZLE_FIRED_0 and NOZZLE_FIRED_1 being at '1' in sample period 1, no recirculation is triggered during recirculation enable time interval 518 in sample period 1. At the end of sample period 1, NOZZLE_FIRED_1 is set to the value of NOZZLE_FIRED_0 (in this case '1'), and NOZZLE_FIRED_0 is reset to '0' (520). Thus, since NOZZLE_FIRED_1 is at '1' during the recirculation enable time interval 522 in sample period 2, recirculation is not triggered.

At the end of sample period 2, NOZZLE_FIRED_1 is updated to the value of NOZZLE_FIRED_0 (524) (in this case '0'), and NOZZLE_FIRED_0 is reset to '0'. During the recirculation enable time interval 526 of sample period 3, both NOZZLE_FIRED_0 and NOZZLE_FIRED_1 are at '0', and as a result, recirculation (528) is triggered.

Figure 6:
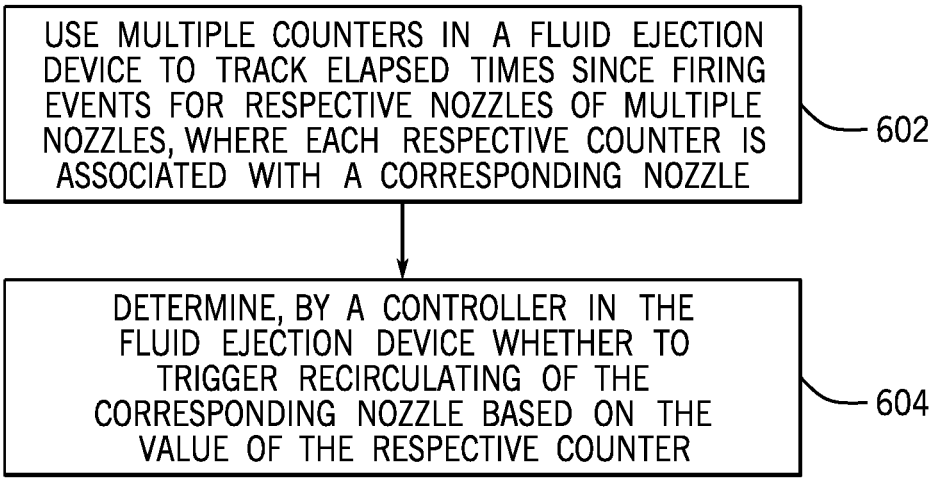
FIG. 6 is a flow diagram for controlling recirculation of nozzles according to some implementations.

FIG. 6 is a flow diagram of an example process for controlling recirculating of nozzles, according to some implementations. The process of FIG. 6 uses (at 602) multiple counters in a fluid ejection device to track an elapsed time since firing events for respective nozzles of multiple nozzles, where each respective counter of the multiple counters is associated with a corresponding nozzle of the multiple nozzles. A counter being associated with a corresponding nozzle can refer to the counter being associated with a single nozzle or with a group of multiple nozzles.

The process further includes determining (at 604), by a controller (such as the recirculation controller 202) in a fluid ejection device, whether to trigger recirculating of the corresponding nozzle based on a value of the respective counter.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A fluid ejection device die assembly comprising:

a plurality of nozzles and corresponding firing chambers;

a plurality of memory elements to enable tracking of nozzle firing events; and a recirculation controller to initiate performance of recirculation of the plurality of nozzles in response to local determinations of firing events of the plurality of nozzles based on values of the plurality of memory elements.

2. The die assembly of claim 1, wherein the local determinations are to be based on indications of sampling time and the tracking of nozzle firing events.

3. The die assembly of claim 1, wherein the local determinations are to be based on a determination of whether nozzle firing events occur during sampling time intervals.

4. The die assembly of claim 3, wherein the performance of recirculation of the plurality of nozzles is to be based on activation of recirculation pumps associated with the plurality of nozzles.

5. The die assembly of claim 1, wherein the local determinations of firing events are to be based on a counter comprising the plurality of memory elements loaded with signals indicative of the firing events.

6. The die assembly of claim 5, wherein the performance of recirculation is to be based on an elapsed time since firing of a nozzle of the plurality of nozzles based on the firing events as tracked using the counter and the plurality of memory elements.

7. The die assembly of claim 1, wherein the performance of recirculation is to be based on a recirculation enable indication that indicates a recirculation enable time interval and a determination that a nozzle firing event has not occurred.

8. The die assembly of claim 7, wherein the performance of recirculation to be performed during the recirculation enable time interval to correspond a portion of a sampling time interval.

9. The die assembly of claim 1, wherein the recirculation controller is to cause the performance of recirculation without reception of recirculation commands from a fluid ejection controller.

10. A fluid ejection device comprising:

nozzles and corresponding firing chambers;

an electrical interface to enable communication of messages, via a communications link, with a fluid ejection controller; and a recirculation controller to:

start a sampling time interval based on a first indication in a message received from the fluid ejection controller;

determine whether a firing event corresponding to the nozzles has occurred; and perform recirculation of the nozzles in response to reception of a second indication from the fluid ejection controller and a determination that a firing event has not occurred.

11. The ejection device of claim 10, comprising a die having the nozzles and the corresponding firing chambers and further wherein the recirculation controller is on the die.

12. The ejection device of claim 10, wherein the first indication is an information element in a header of a first print packet that contains print data controlling firing of the nozzles, and the second indication is an information element in a header of a second print packet that contains print data controlling firing of the nozzles.

13. A method of recirculating nozzle of a fluid ejection device die, the method comprising:

determining locally, by a controller of the fluid ejection device die, that a nozzle of a plurality of nozzles has not fired within a sample period; and triggering, by the controller, recirculation of the nozzle in response to the determining.

14. The method of claim 13, wherein the determining is based on a value of a firing event tracking counter, the counter associated with the nozzle of the plurality of nozzles.

15. The method of claim 14, further comprising responsive to a firing event occurring for the nozzle, resetting the counter associated with the nozzle.

16. The method of claim 14, further comprising updating the value in the counter associated with the nozzle for a new sampling period in response to detecting that nozzle has not fired during the sample period.

17. The method of claim 16, further comprising receiving, by the controller, a first indication that starts the new sampling period.

18. The method of claim 17, further comprising receiving, by the controller, a second indication that a recirculation enable time period during which recirculation of the nozzles is allowed, wherein the recirculation of the nozzle is responsive to the recirculation enable indication and the value of the counter.

* * * * *